US009750988B1

(12) United States Patent
Auld et al.

(10) Patent No.: US 9,750,988 B1
(45) Date of Patent: Sep. 5, 2017

(54) HOCKEY PUCK STORAGE AND DISPENSING UNIT

(71) Applicants: Winston J. Auld, Niagara Falls (CA); Elaine A. Auld, Niagara Falls (CA)

(72) Inventors: Winston J. Auld, Niagara Falls (CA); Elaine A. Auld, Niagara Falls (CA)

( * ) Notice: Subject to any disclaimer, the term of this patent is extended or adjusted under 35 U.S.C. 154(b) by 0 days.

(21) Appl. No.: 14/929,688

(22) Filed: Nov. 2, 2015

Related U.S. Application Data

(60) Provisional application No. 62/076,108, filed on Nov. 6, 2014.

(51) Int. Cl.
*A63B 69/00* (2006.01)
*A63B 47/00* (2006.01)

(52) U.S. Cl.
CPC ..... *A63B 47/002* (2013.01); *A63B 69/0026* (2013.01)

(58) Field of Classification Search
CPC ... A63B 2102/24; A63B 47/02; A63B 63/004; A63B 69/0026
USPC ..... 473/446, 180; 206/747–749; 220/817, 220/822, 826
See application file for complete search history.

(56) References Cited

U.S. PATENT DOCUMENTS 3,700,243 A * 10/1972 Kenney ..... A63B 57/357 206/315.9
3,817,535 A * 6/1974 Doughty ..... A63F 7/305 473/185
3,977,521 A * 8/1976 Murphy ..... A47B 81/00 206/315.1
4,565,375 A * 1/1986 Dresel ..... A63B 67/06 273/401
4,936,454 A * 6/1990 Wang ..... B42F 7/06 206/425
5,147,061 A * 9/1992 Karpisek ..... B65D 77/061 220/1.5
5,702,140 A 12/1997 Radja
6,079,930 A * 6/2000 Valdes-Rodriguez A63B 47/021 294/19.2

(Continued)

OTHER PUBLICATIONS

Puck Keeper Puck Bag. Product listing [online]. Sideline Sports, 2009. [Retrieved on Aug. 26, 2014]. Retrieved on the Internet: http://www.hockeyshot.com/Puck-Keeper-Puck-Bag-p/coaching-033.htm.

(Continued)

*Primary Examiner* — Mark Graham
(74) *Attorney, Agent, or Firm* — Robert C. Montgomery; Montgomery Patent & Design, LP.

(57) ABSTRACT

A device for storing and dispensing hockey pucks includes a box defining an interior capable of receiving a plurality of the hockey pucks, wherein the box comprises a first door opening and a second door opening disposed approximately perpendicular to the first door opening, a first door pivotably attached to the box within the first door opening, wherein, when closed, the first door encloses the interior when closed, and wherein, when open, the first door forms a ramp for receiving the hockey pucks through the first door opening and into the interior, and a second door pivotably attached to the box within the second door opening, wherein, when closed, the second door encloses the interior, and wherein, when open, the second door dispenses the hockey pucks from the interior through the second opening.

18 Claims, 5 Drawing Sheets

(56) References Cited

U.S. PATENT DOCUMENTS

| | | | | |
|---|---|---|---|---|
| 6,398,661 | B1 * | 6/2002 | Llewellyn | A63B 63/00 473/180 |
| 6,405,888 | B1 * | 6/2002 | Overholt | B65D 11/1833 220/1.5 |
| 6,513,845 | B2 * | 2/2003 | Campomane | A63B 47/02 206/315.9 |
| 6,629,607 | B1 * | 10/2003 | Gibson | A45C 11/20 206/551 |
| 7,066,847 | B2 | 6/2006 | Power | |
| 8,590,893 | B2 * | 11/2013 | Monopoli | A63B 67/00 273/108 |
| 2006/0116224 | A1 | 6/2006 | Andersen | |
| 2006/0252581 | A1 | 11/2006 | Wegryn | |
| 2008/0015060 | A1 * | 1/2008 | Erickson | A63B 63/004 473/446 |
| 2009/0023523 | A1 * | 1/2009 | Poillucci | A63B 47/007 473/478 |
| 2009/0127877 | A1 | 5/2009 | Wright | |
| 2011/0077108 | A1 * | 3/2011 | Gulka | A63B 47/002 473/446 |
| 2015/0174466 | A1 * | 6/2015 | Folland | A63B 71/0036 206/315.1 |

OTHER PUBLICATIONS

Nice Rink Puck Bucket. Product listing [online]. Sears, 2014. [Retrieved on Aug. 26, 2014]. Retrieved on the Internet: http://www.sears.com/nice-rink-pucket-puck-bucket-no-more/p-SPM1358926701.

* cited by examiner

HOCKEY PUCK STORAGE AND DISPENSING UNIT

RELATED APPLICATIONS

The present invention is a continuation-in-part of, was first described in, and claims the benefit of U.S. Provisional Application No. 62/076,108, filed Nov. 6, 2014, the entire disclosures of which are incorporated herein by reference.

FIELD OF THE INVENTION

The present invention relates generally to structures for storing or dispensing objects and, more particularly, to a storage and dispensing device for storing and dispensing hockey pucks.

BACKGROUND OF THE INVENTION

When playing or practicing the game of hockey, a lot of pucks are required in order to maintain a proper practice. This is to ensure everyone participating can practice shooting, passing, or basic puck keeping skills. When performing these practice skills on ice, it is imperative that the pucks can be gathered in a single place because of the tendency for the pucks to travel farther due to the relative lack of friction of practicing on ice.

Gathering pucks is time consuming because of the need to bend over and grab a myriad of pucks and place them in a container. There is therefore a need to provide a puck holding container.

SUMMARY OF THE INVENTION

The inventor has recognized the aforementioned inherent problems and lack in the art and observed that there is a need for a puck holding container that allows users to "shoot" or otherwise direct pucks inside of the container while also being capable of easily dispensing the pucks housed inside. The development of the present invention, which will be described in greater detail herein, substantially departs from conventional solutions to fulfill this need.

In one (1) embodiment, the disclosed device for storing and dispensing hockey pucks includes a box defining an interior capable of receiving a plurality of the hockey pucks, wherein the box comprises a first door opening and a second door opening disposed approximately perpendicular to the first door opening, a first door pivotably attached to the box within the first door opening, wherein, when closed, the first door encloses the interior when closed, and wherein, when open, the first door forms a ramp for receiving the hockey pucks through the first door opening and into the interior, and a second door pivotably attached to the box within the second door opening, wherein, when closed, the second door encloses the interior, and wherein, when open, the second door dispenses the hockey pucks from the interior through the second opening.

In another embodiment, the disclosed device for storing and dispensing hockey pucks includes a box defining an interior capable of receiving a plurality of hockey pucks, wherein the box includes a first side, a first door opening disposed in the first side, a second side opposite the first side, a first end, a second end opposite the first end, a second door opening disposed in the second end, a top, and a bottom, wherein the bottom slopes downward from the first side to the second side. The device also includes a first door pivotably attached to the box within the first door opening, wherein, when closed, the first door encloses the interior when closed, and wherein, when open, the first door forms a ramp for receiving the hockey pucks through the first door opening and into the interior, and a second door pivotably attached to the box within the second door opening, wherein, when closed, the second door encloses the interior, and wherein, when open, the second door dispenses the hockey pucks from the interior through the second opening.

In yet another embodiment, the disclosed device for storing and dispensing hockey pucks includes a box defining an interior capable of receiving a plurality of hockey pucks, wherein the box includes a first side, a first door opening disposed in the first side, a second side opposite the first side, a first end, a second end opposite the first end, a second door opening disposed in the second end, a top, a bottom, wherein the bottom slopes downward from the first side to the second side, a plurality of bottom apertures disposed through the bottom to drain water from within the interior, at least two (2) second side apertures disposed through the second side to enable tilting of the box about the first side to dispense the hockey pucks from within the interior through the first door opening, a first end aperture disposed through the first end to enable tilting the box about the second end to dispense the hockey pucks from within the interior through the second door opening, an opposed pair of first door slide apertures, a first door slide aperture disposed in each of the first end and the second end near the bottom, an opposed pair of first door latch apertures, a first door latch aperture disposed in each of the first end and the second end near the top, and an opposed pair of second door slide apertures, a second door slide aperture disposed in each of the first side and the second side near the bottom. The device also includes a first door pivotably attached to the first side within the first door opening, wherein when closed, the first door encloses the interior when closed, and when open, the first door forms a ramp for receiving the hockey pucks through the first door opening and into the interior. The first door includes an opposed pair of first door pivot pins near a first door bottom edge, an opposed pair of first door latch pins near a first door top edge, an opposed pair of ramp ridges extending from a first door bottom edge to a first door top edge on opposing sides of the ramp, and a ramp nose extending along the first door top edge, wherein the first door pivot pins are rotatably and slidably retained within the first door slide apertures to allow the first door to open and close, the first door latch pins are releasably retained within the first door latch apertures when the first door is closed. The device also includes a second door pivotably attached to the second end within the second door opening, wherein when closed, the second door encloses the interior, and when open, the second door dispenses the hockey pucks from the interior through the second opening. The second door includes an opposed pair of second door pivot pins near a second door top edge, and a second door tab protruding from a second door bottom edge, wherein the second door pivot pins are rotatably and slidably retained within the second door slide apertures to allow the second door to open and close, and the second door tab is releasably retained within the second door slot when the second door is closed.

Furthermore, the described features and advantages of the embodiments disclosed by this disclosure may be combined in various manners and implementations as one skilled in the relevant art will recognize. Various embodiments can be practiced without one or more of the features and advantages described in a particular embodiment disclosed by this disclosure.

Further advantages of the embodiments disclosed by the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
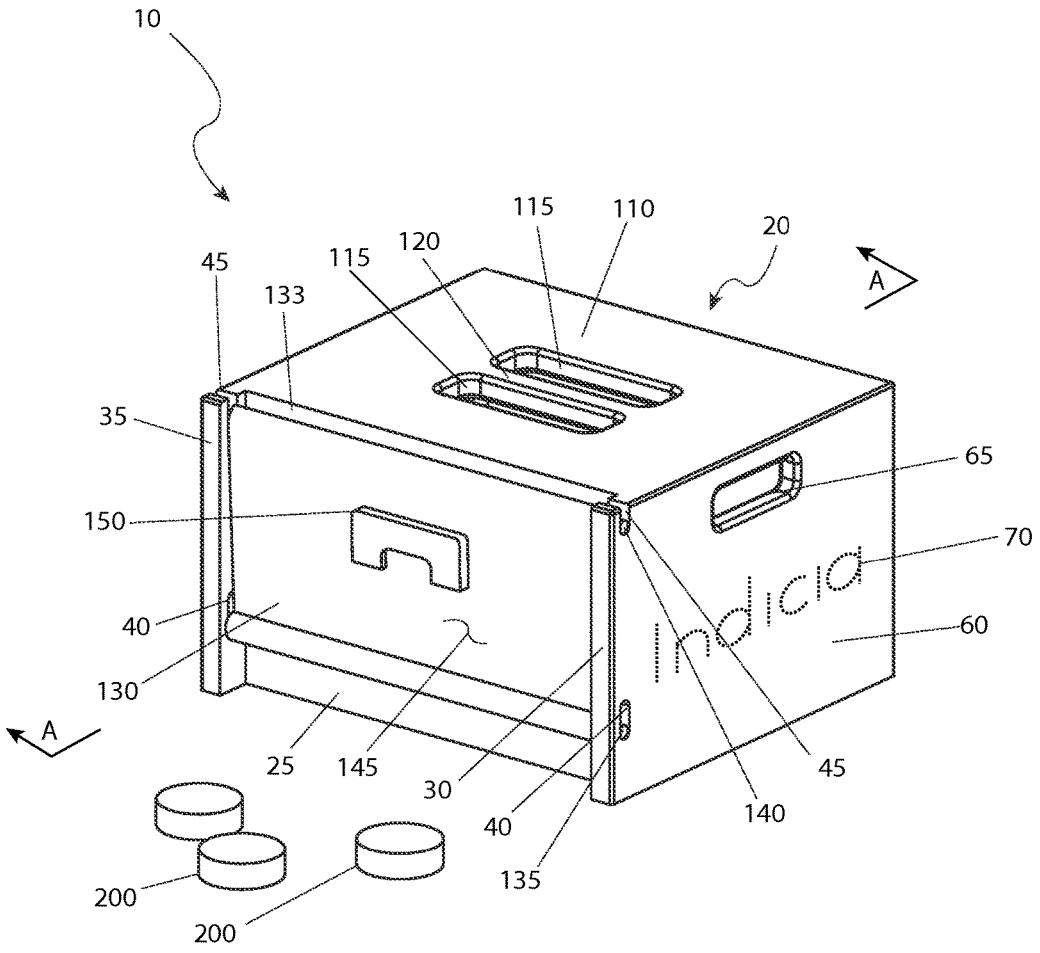
FIG. 1 is an isometric view of a puck container for pick-up, storage, and dispensing of hockey pucks, in accordance with one embodiment of the present invention.

10 puck container
20 box
25 first side
30 first stile
32 first door opening
35 second stile
40 first door slide aperture
45 first door latch aperture
50 second side
55 second side aperture
60 first end
65 first end aperture
70 indicia
75 second end
80 third stile
85*a* second door slide aperture
85*b* second door blind slide aperture
90 second door inset
93 second door slot
95 second door opening
100 bottom
105 bottom aperture
110 top
115 handle aperture
120 center strut
125 interior
130 first door
133 first door top edge
135 first door pivot pin
140 first door latch pin
145 first door exterior
150 first door actuator
155 ramp face
160 ramp ridge
165 ramp nose
170 second door
175 second door pivot pin
178 second door top edge
180 door tab
185 second door exterior
190 second door actuator
200 hockey puck

DETAILED DESCRIPTION OF THE PREFERRED EMBODIMENT

In accordance with the invention, the best mode is presented in terms of a one or more of the disclosed embodiments, herein depicted within FIGS. 1 through 5. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, singular terms such as "a", "an", and "the" do not denote a limitation of quantity, but rather denote the presence of at least one (1), as well as a plurality of, the referenced items, unless the context clearly indicates otherwise.

As used herein, terms such as "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one element, feature and/or region to another element, feature and/or region as illustrated in the figures.

Referring generally to FIGS. 1-5, a puck container (herein described as the "device") 10 is disclosed, where like reference numerals represent similar or like parts. Generally, the disclosed device 10 provides for the pick-up, storage, and dispensing of a plurality of hockey pucks 200 to collect and store the hockey pucks 200 easily and efficiently so as to have them available for an ensuing event. It is envisioned that in various embodiments, the device 10 may be presented in a different size so as to be capable of storing more, or fewer, hockey pucks 200 without limitation.

Figure 3:
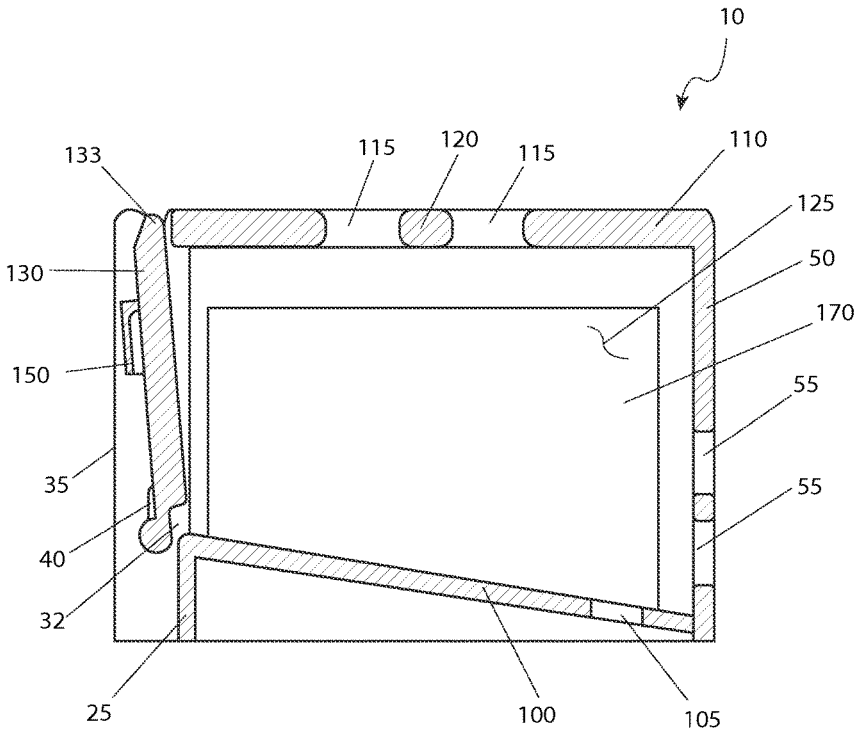
FIG. 3 is a section view of the puck container, taken along line A-A of FIG. 1, in accordance with one embodiment of the present invention.

Referring to FIG. 1, an isometric view of the device 10, according one embodiment of the present invention, is disclosed. The device 10 includes a box 20 having a first side 25, a planar second side 50, a planar first end 60, a second end 75, a planar top 110 and a sloped bottom 100 joined along all horizontal and vertical abutting edges to form an interior 125 (FIG. 3).

As one example, the box 20 is made from a plurality of injection-molded thermoplastic pieces fitted together in a manufacturing process necessary to yield the finished product in the shape of a rectangular prism. As such, the box 20 may be presented in a wide variety of sizes, colors, and surface textures.

Figure 4:
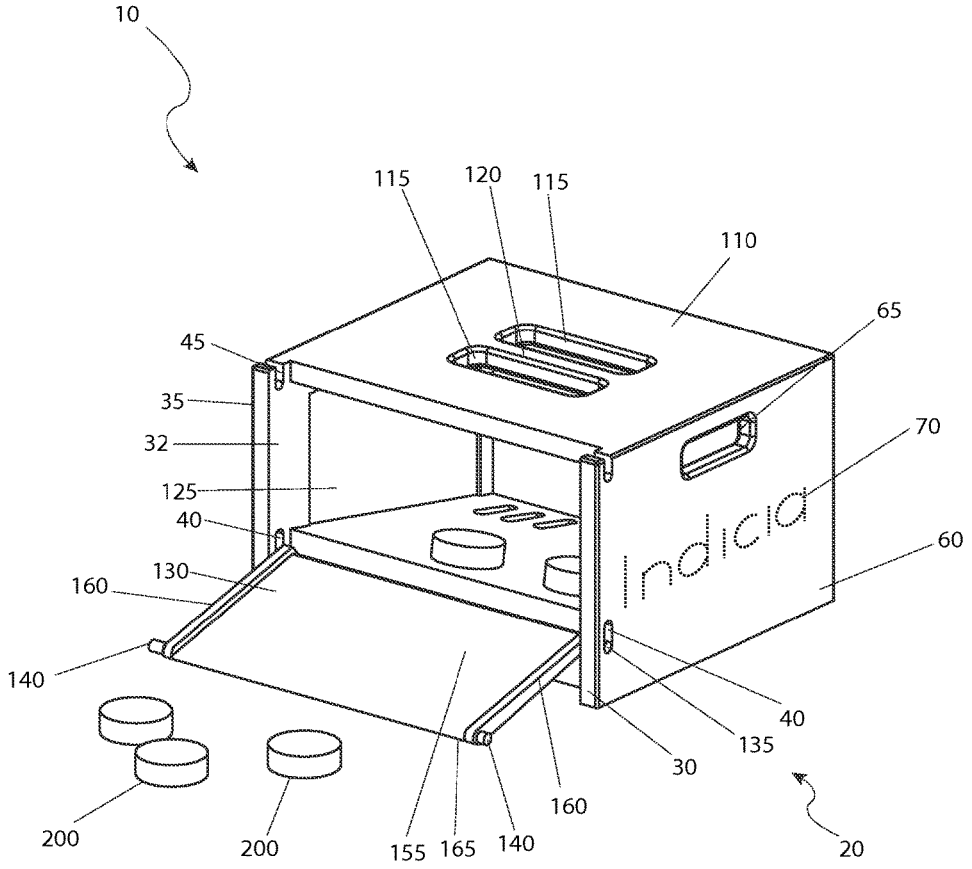
FIG. 4 is an isometric view of the puck container shown with a first door open, in accordance with one embodiment of the present invention; and, FIG. 5 is an isometric view of the puck container shown with a second door open, in accordance with the one embodiment of the present invention.

Referring to FIGS. 1 and 4, the first side 25 is more of a nominal position than a physical vertical barrier as the majority of the first side 25 is formed by a first door 130 enclosing a first door opening 32, on a longer side of the box 20 (FIG. 4). The first door 130 is a planar cover for the first door opening 32 having a pair of first door pivot pins 135 located on either side of the first door 130 in proximity to a first door bottom edge. The first door 130 is also provided with a pair of first door latch pins 140. The first door latch pins 140 are located on either side of the first door 130 adjacent to the first door top edge 133.

The first side 25 has a first stile 30 configured to essentially be a corner in conjunction with the first end 60. A second stile 35 is located at an opposite position along the first side 25 as a corner in conjunction with the second end 75. The first stile 30 and the second stile 35 have identical corresponding first door pin apertures 40 and first door latch apertures 45 to accommodate the respective first door pivot pins 135 and first door latch pins 140 to mount the first door 130.

The first door pivot pins 135 are configured to be assembled into the first door pin apertures 40 for the purpose of hingedly connecting the first door 130 to the box 20. The first door pin apertures 40 are elongated slots with semicircular ends to accommodate lifting the first door 130 slightly to disengage the first door latch pins 140 from the first door latch apertures 45 so as to be able to pivot the first door 130 about the first door pivot pins 135 in order to open the first door 130.

The first door 130 is provided with a first door actuator 150 located on the first door exterior 145. The first door actuator 150 is a handle adapted to be manipulated by a user as a means to raise and rotate the first door 130.

Figure 2:
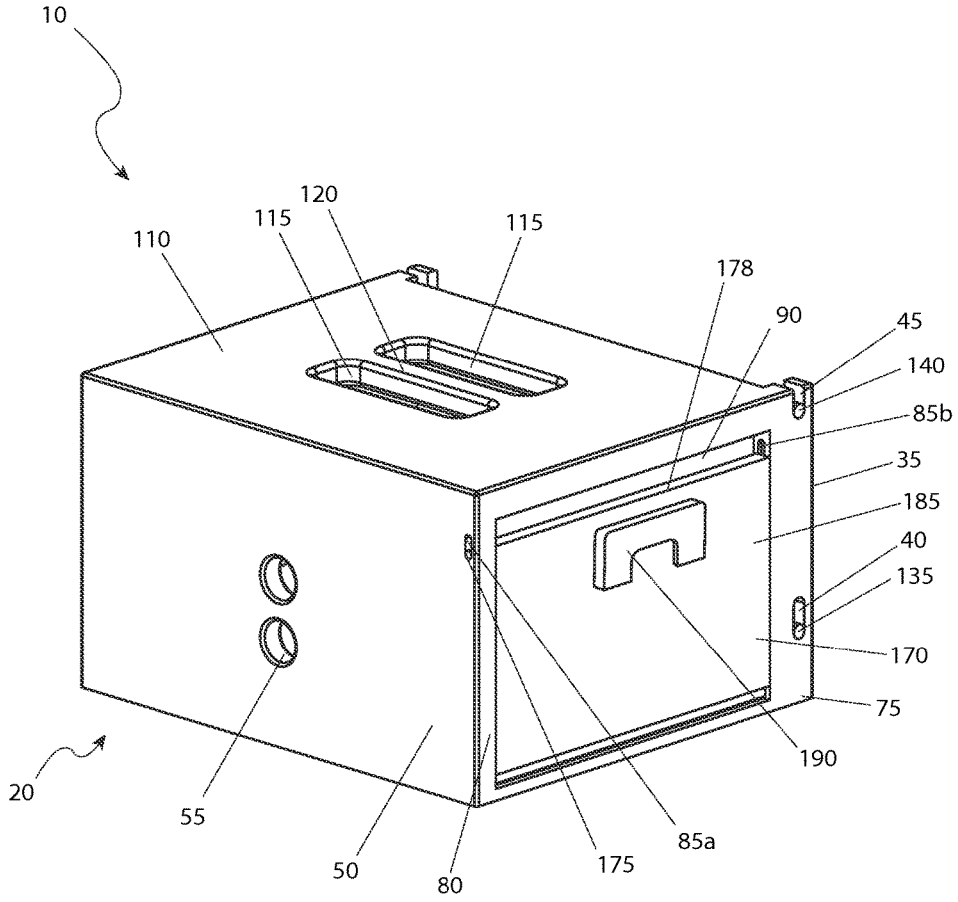
FIG. 2 is an isometric view of the puck container, as viewed from a different angle from FIG. 1, in accordance with one embodiment of the present invention.

Referring to FIGS. 1 and 2, the first end 60 is configured to be a planar vertical barrier on a narrow end of the box 20 being perpendicular to the first side 25. A second door 170 is located in a second end 75 of the box 20 (FIG. 2). However, the device 10 is not limited to the arrangement shown here as the first end 60 may be on either the right or left side without limiting the scope, or the intent of the device 10.

For the purpose of this disclosure, the first end 60 is that end of the box 20 in which a first end aperture 65 is disposed. The first end aperture 65 is a horizontal slot, having semicircular ends, into which a user may place a portion of a hand; lift the first end 60 of the box 20 so as to position the box 20 at a declining angle; and, enable any hockey pucks 200 contained within the interior 125 to be dislodged and dispensed out of the second door 170 (see FIG. 5).

It is envisioned that some surface portions of the box 20 may include various indicia 70, which may provide script or logos based upon a user's preference and may include images such as, but not limited to, business names, team logos, personal names, symbols, lines, pictures, and the like, in various colors and patterns, to further customize and personalize the device 10.

Referring to FIGS. 1-5, disposed in the top 110 of the box 20 are two (2) handle apertures 115. The handle apertures 115 are configured to be oval-shaped or similarly shaped slots arranged such that a center strut 120, located between the handle apertures 115, can serve as a handle by which the box 10 may be transported, with, or without, hockey pucks 200 in the interior 125, from one location to another.

Referring to FIG. 2, an isometric view of the device 10, from a viewing angle different that FIG. 1, according to one (1) embodiment of the present invention, is disclosed. The second side 50 is configured to be a planar vertical barrier on a longer side of the box 20 opposite from the first side 25. Two (2) circular second side apertures 55 are disposed in the second side 50, into which a user may place one (1) or more fingers and a thumb of a hand for the purpose of position the box 20 at a declining angle to dispense contained hockey pucks 200 through the first door 130.

Figure 5:
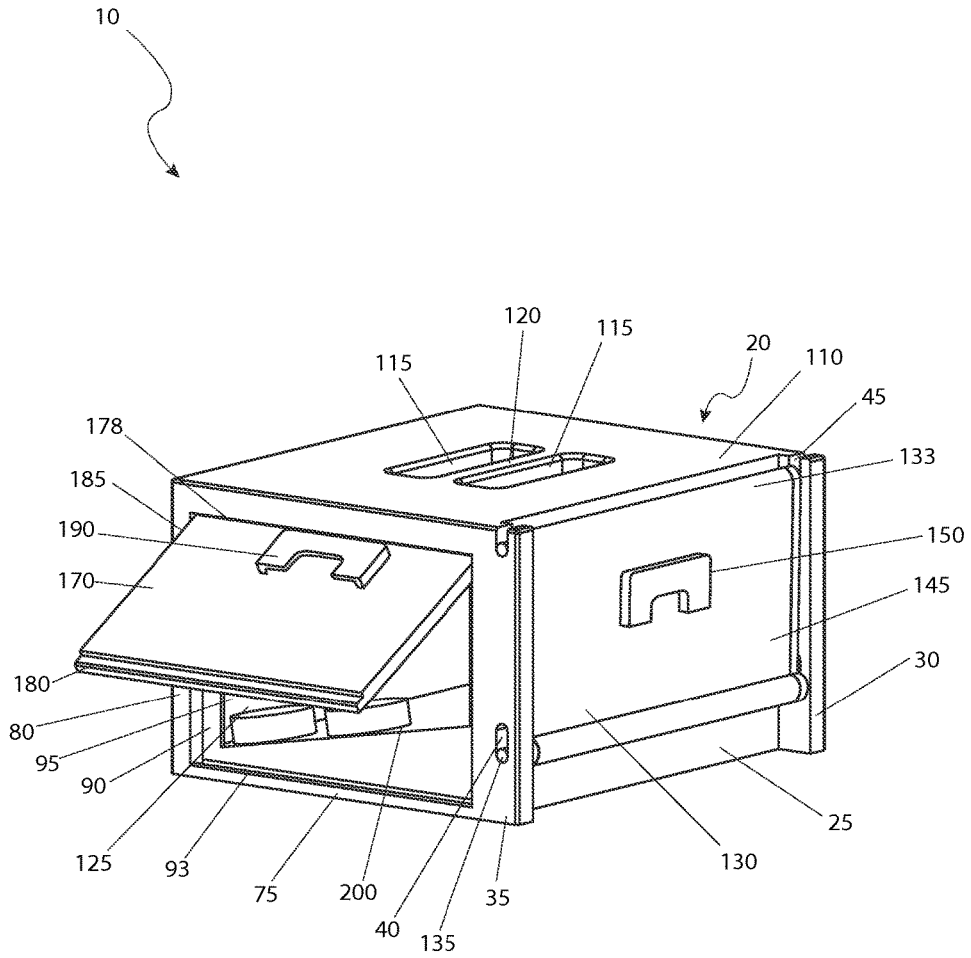

Referring to FIGS. 2 and 5, the second end 75, similar to the first side 25 includes a second door opening 95 (FIG. 5). This second door opening 95 is an aperture in a second door inset 90 formed into the second end 75. A second door slot 93 is a crease, or slot, in a lower face of the second door inset 90 in the second end 75 (FIG. 5).

The second end 75, as previously discussed, shares a second stile 35 with the first side 25. A third stile 80 is located at an opposite position from the second stile 35 along the second end 75 as a corner in conjunction with the second side 50. The third stile 80 is provided with a second door slide aperture 85*a* into which a second door pivot pin 175 is inserted as a means to pivotally install the second door 170. Disposed in the second stile 35 is a second door blind slide aperture 85*b* having similar function to the second door slide pin aperture 85*a*. However, due to the proximity of the latch aperture 45 of the first door 130 in that same second stile 35 the depth of the second door blind slide aperture 85*b* must be truncated so as to not interfere with the first door latch aperture 45. The second door slide apertures 85*a*, 85*b* are configured to be elongated slots with semicircular ends to accommodate lifting the second door 170 slightly to disengage the door tab 180 from the second door slot 93 so as to be able to pivot the second door 170 about the second door slide pins 175 in order to open the second door 170.

The second door inset 90 is adapted to span a space between the second stile 35 and the third stile 80 (FIG. 5). The second door 170 is a planar cover of the second door opening 95 having a pair of second door slide pins 175 located on either side of the second door 170 in proximity to a second door top edge 178. The second door 170 is also provided with a door tab 180 (FIG. 5), along an edge opposite from the second door top edge 178. This door tab 180 is adapted to fit within the second door slot 93 to secure the closure of the second door 170. The second door 170 is provided with a second door actuator 190 located on the second door exterior 185. The second door actuator 190 is a handle, similar to the first door actuator 140 as pictured in FIG. 1, adapted to be manipulated by a user as a means to raise and rotate the second door 170.

Referring to FIG. 3, a section view taken along line A-A, as shown in FIG. 1, of the device 10, according to one (1) embodiment of the present invention, is disclosed. The bottom 100 of the box 20 is configured to be sloped downwardly from the entry of a hockey puck 200 on the first side 25, to the second side 50. The intended purpose of this arrangement is to function positively in regard to retaining the hockey pucks 200 within the interior 125. Additionally, some moisture may inadvertently be introduced into the interior 125, either by transferring shaved ice on a hockey puck 200 or by condensed moisture resulting from the hockey pucks 200 being frozen prior to play in a conventional manner. The sloped bottom 100 provides a means to direct the collected water to a plurality of bottom apertures 105 disposed in the bottom 100 whereby the collected water may exit the interior 125. The bottom apertures 105 may be lateral or longitudinal slots in proximity to the second side 50. Other configurations may be utilized for the bottom apertures 105 without limiting the scope of the device 10.

Referring to FIG. 4, an isometric view of the device 10, with the first door 130 in an open state so as to receive hockey pucks 200, according to one (1) embodiment of the present invention, is disclosed. The aforementioned first door 130 is configured to pivot about the first door pivot pins 135 in the first door pin apertures 40. This pivoting action reveals a ramp face 155 disposed on that side of the first door 130 directed toward the interior 125 of the box 20. The first door 130 will pivot without restriction to touch upon the ice surface thereby forming a ramp via which the hockey pucks 200 may be slid into the interior 125 of the box 20.

The first door 130 is provided with a ramp nose 165 at the first door top edge 133, which provides a tapered edge portion of the first door 130 to assist the hockey pucks 200 onto the ramp face 155 with a minimal amount of obstruction.

Vertically protruding extensions of parallel outer edges of the ramp face 155 constitute ramp ridges 160. A ramp ridge 160 on either side of the ramp face 155 prevents the hockey pucks 200 from sliding off of the sides of the ramp face 155 prior to entering the interior 125.

After all of the hockey pucks 200 are pushed into the box 20, the first door 130 may be rotated into the first door opening 32 to close the first door 130. The first door 130 may be raised slightly in the first door pin apertures 40 to allow the first door latch pins 140 to be engaged within the first door latch apertures 45.

Referring to FIG. 5, an isometric view of the device 10, with the second door 170 partially opened to dispense hockey pucks 200, according to one (1) embodiment of the present invention, is disclosed. The second door 170 can be selectively opened to permit the hockey pucks 200 to exit from the interior 125 of the box 20. The slope of the bottom 100 relative to the second door inset 90 is clearly illustrated in FIG. 5. The second door slot 93 at the lower edge of the second door inset 90 is also clearly illustrated.

Those skilled in the art will recognize that other styles and configurations of the disclosed device 10 can be easily incorporated into the teachings of the present disclosure, and that only particular configurations have been shown and described for purposes of clarity and disclosure and not by way of limitation of scope.

The example embodiments of the present invention can be utilized by the common user in a simple and effortless manner with little or no training. After initial purchase or acquisition of the device 10, it would be arranged and utilized as indicated in FIGS. 1-5.

The method of arranging and utilizing the device 10 may be achieved by performing the following steps: acquiring a model of the device 10 having a desired size and style to suit the taste of a user; placing the device 10 on the ice surface at some location in which an obstruction, such as the boards or the net, may obviate any displacement of the device 10; orienting the first door 130 away from the stabilizing obstruction; raising the first door 130 slightly, by manipulating the first door actuator 150, to disengage the first door latch pins 140 from the first door latch apertures 45; rotating the first door 130 about the first door pivot pins 135 in the first door pin apertures 40 to lower the ramp nose 165 onto the ice surface, thereby exposing the ramp face 155; utilizing a hockey stick, or other similar device, to push a desired number of hockey pucks 200 up the ramp face 155, between the ramp ridges 160, into the interior 125; and, closing and latching the first door 130 by engaging the first door latch pins 140 and first door latch apertures 45.

The device 10 may be transported to another location for retrieval of additional hockey pucks 200, if desired, by placing one (1) or more digits into one (1) of the handle apertures 115 and the thumb of the same hand into the other handle aperture 115, and carrying the device 10 by grasping and lifting the center strut 120.

The hockey pucks 200 may be removed from the interior 125 of the box 29 by manipulating the second door actuator 190 to enable displacement of the door tab 180 from the second door slot 93; rotating the second door 170 about the second door slide pins 175 in the slide apertures 85*a*, 85*b*; opening the second door 170; manipulating the device 10 using the handle apertures 115, center strut 120, and second side apertures 55 to eject a desired number of hockey pucks 200 at a desired location.

Accordingly, the disclosed device 10 beneficially provides an efficient and convenient means to collect and store a plurality of hockey pucks 200.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A device for storing and dispensing hockey pucks, said device comprising:

a box defining an interior capable of receiving a plurality of said hockey pucks, wherein said box comprises a first side, a first door opening disposed in said first side, a second side opposite said first side, a first end, a second end opposite said first end, a top, a bottom, and a second door opening disposed in said second end and approximately perpendicular to said first door opening;

a first door pivotably attached to said box within said first door opening, wherein, when closed, said first door encloses said interior when closed, and wherein, when open, said first door forms a ramp for receiving said hockey pucks through said first door opening and into said interior; and, a second door pivotably attached to said box within said second door opening, wherein, when closed, said second door encloses said interior, and wherein, when open, said second door dispenses said hockey pucks from said interior through said second opening;

wherein said bottom slopes downward from said first side to said second side.

2. The device of claim 1, wherein said box further comprises a plurality of bottom apertures disposed through said bottom to drain water from within said interior.

3. The device of claim 1, wherein said box comprises at least two second side apertures disposed through said second side to enable tilting of said box about said first side to dispense said hockey pucks from within said interior through said first door opening, when said first door is open.

4. The device of claim 1, wherein said box comprises a first end aperture disposed through said first end to enable tilting said box about said second end to dispense said hockey pucks from within said interior through said second door opening, when said second door is open.

5. The device of claim 1, wherein:

said box further comprises:

an opposed pair of first door slide apertures, a first door slide aperture disposed in each of said first end and said second end near said bottom; and, an opposed pair of first door latch apertures, a first door latch aperture disposed in each of said first end and said second end near said top;

said first door comprises:

an opposed pair of first door pivot pins near a first door bottom edge; and, an opposed pair of first door latch pins near a first door top edge;

said first door pivot pins are rotatably retained within said first door slide apertures to allow said first door to open and close; and, said first door latch pins are releasably retained within said first door latch apertures when said first door is closed.

6. The device of claim 5, wherein each of said first door slide apertures comprises an elongated slot having opposed semicircular ends; and wherein said first door pivot pins are slidably retained within said first door slide apertures and movable between said semicircular ends.

7. The device of claim 5, wherein each one of said first door latch apertures comprises a semicircular slot having an open top end; and wherein said first door latch pins sit inside said first door latch apertures when said first door is closed.

8. The device of claim 1, wherein:

said box further comprises an opposed pair of second door slide apertures, a second door slide aperture disposed in each of said first side and said second side near said top;

said second door comprises an opposed pair of second door pivot pins near a second door top edge; and, said second door pivot pins are rotatably retained within said second door slide apertures to allow said second door to open and close.

9. The device of claim 8, wherein each of said second door slide apertures comprises an elongated slot having opposed semicircular ends; and wherein said second door pivot pins are slidably retained within said second door slide apertures and movable between said semicircular ends.

10. The device of claim 8, wherein:

said box further comprises a second door slot disposed within said second end along a lower edge of said second door opening;

said second door comprises a second door tab protruding from a second door bottom edge; and, said second door tab is releasably retained within said second door slot when said second door is closed.

11. The device of claim 1, wherein said box further comprises a pair of handle apertures disposed through said top and separated by a center strut.

12. The device of claim 1, wherein said first door comprises an opposed pair of ramp ridges extending from a first door bottom edge to a first door top edge.

13. The device of claim 1, wherein said first door comprises a ramp nose extending along a first door top edge.

14. A device for storing and dispensing hockey pucks, said device comprising:

a box defining an interior capable of receiving a plurality of hockey pucks, wherein said box comprises:

a first side;

a first door opening disposed in said first side;

a second side opposite said first side;

a first end;

a second end opposite said first end;

a second door opening disposed in said second end;

a top; and, a bottom, wherein said bottom slopes downward from said first side to said second side;

a first door pivotably attached to said box within said first door opening, wherein, when closed, said first door encloses said interior when closed, and wherein, when open, said first door forms a ramp for receiving said hockey pucks through said first door opening and into said interior; and, a second door pivotably attached to said box within said second door opening, wherein, when closed, said second door encloses said interior, and wherein, when open, said second door dispenses said hockey pucks from said interior through said second opening.

15. The device of claim 14, wherein said box further comprises:

a plurality of bottom apertures disposed through said bottom to drain water from within said interior;

at least two second side apertures disposed through said second side to enable tilting of said box about said first side to dispense said hockey pucks from within said interior through said first door opening, when said first door is open;

a first end aperture disposed through said first end to enable tilting said box about said second end to dispense said hockey pucks from within said interior through said second door opening, when said second door is open.

16. The device of claim 14, wherein:

said box further comprises:

an opposed pair of first door slide apertures, a first door slide aperture disposed in each of said first end and said second end near said bottom;

an opposed pair of first door latch apertures, a first door latch aperture disposed in each of said first end and said second end near said top;

an opposed pair of second door slide apertures, a second door slide aperture disposed in each of said first side and said second side near said top; and, comprises a second door slot disposed within said second end along a lower edge of said second door opening;

said first door comprises:

an opposed pair of first door pivot pins near a first door bottom edge; and, an opposed pair of first door latch pins near a first door top edge;

said second door comprises:

an opposed pair of second door pivot pins near a second door top edge; and, a second door tab protruding from a second door bottom edge;

said first door pivot pins are rotatably and slidably retained within said first door slide apertures to allow said first door to open and close;

said first door latch pins are releasably retained within said first door latch apertures when said first door is closed;

said second door pivot pins are rotatably and slidably retained within said second door slide apertures to allow said second door to open and close; and, said second door tab is releasably retained within said second door slot when said second door is closed.

17. The device of claim 14, wherein said first door comprises:

an opposed pair of ramp ridges extending from a first door bottom edge to a first door top edge; and, a ramp nose extending along said first door top edge.

18. A device for storing and dispensing hockey pucks, said device comprising:

a box defining an interior capable of receiving a plurality of hockey pucks, wherein said box comprises:

a first side;

a first door opening disposed in said first side;

a second side opposite said first side;

a first end;

a second end opposite said first end;

a second door opening disposed in said second end;

a top;

a bottom, wherein said bottom slopes downward from said first side to said second side;

a plurality of bottom apertures disposed through said bottom to drain water from within said interior;

at least two second side apertures disposed through said second side to enable tilting of said box about said first side to dispense said hockey pucks from within said interior through said first door opening;

a first end aperture disposed through said first end to enable tilting said box about said second end to dispense said hockey pucks from within said interior through said second door opening;

an opposed pair of first door slide apertures, a first door slide aperture disposed in each of said first end and said second end near said bottom;

an opposed pair of first door latch apertures, a first door latch aperture disposed in each of said first end and said second end near said top; and, an opposed pair of second door slide apertures, a second door slide aperture disposed in each of said first side and said second side near said top;

a first door pivotably attached to said first side within said first door opening, wherein:

when closed, said first door encloses said interior when closed;

when open, said first door forms a ramp for receiving said hockey pucks through said first door opening and into said interior;

said first door comprises:

an opposed pair of first door pivot pins near a first door bottom edge;

an opposed pair of first door latch pins near a first door top edge;

an opposed pair of ramp ridges extending from a first door bottom edge to a first door top edge on opposing sides of said ramp; and, a ramp nose extending along said first door top edge;

said first door pivot pins are rotatably and slidably retained within said first door slide apertures to allow said first door to open and close; and, said first door latch pins are releasably retained within said first door latch apertures when said first door is closed;

a second door pivotably attached to said second end within said second door opening, wherein:

when closed, said second door encloses said interior;

when open, said second door dispenses said hockey pucks from said interior through said second opening; and, said second door comprises:

an opposed pair of second door pivot pins near a second door top edge; and, a second door tab protruding from a second door bottom edge;

said second door pivot pins are rotatably and slidably retained within said second door slide apertures to allow said second door to open and close; and, said second door tab is releasably retained within said second door slot when said second door is closed.

* * * * *